US006635159B1

(12) United States Patent
Marttila

(10) Patent No.: US 6,635,159 B1
(45) Date of Patent: Oct. 21, 2003

(54) DEVICE FOR REMOVING DEPOSIT CREATED IN ELECTROLYTIC REFINING OR ELECTROWINNING

(75) Inventor: Tom Marttila, Verkkokuja (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/979,954

(22) PCT Filed: May 19, 2000

(86) PCT No.: PCT/FI00/00456

§ 371 (c)(1),
(2), (4) Date: Nov. 27, 2001

(87) PCT Pub. No.: WO00/77277

PCT Pub. Date: Dec. 21, 2000

(30) Foreign Application Priority Data

Jun. 10, 1999 (FI) ..... 991325

(51) Int. Cl.[7] ..... B23H 7/26

(52) U.S. Cl. ..... 204/297.01; 204/297.06; 204/297.07; 204/297.08; 204/286.1; 204/288.5; 204/281; 204/208; 204/216

(58) Field of Search ..... 204/286.1, 288.5, 204/297.01, 297.06, 297.07, 297.08, 208, 216, 281

(56) References Cited

U.S. PATENT DOCUMENTS

| | | | | |
|---|---|---|---|---|
| 3,807,020 A | | 4/1974 | Van Raevels et al. | 29/200 D |
| 3,953,312 A | * | 4/1976 | Kikkawa et al. | 204/281 |
| 4,264,405 A | | 4/1981 | Petrov et al. | 156/584 |
| 4,417,953 A | | 11/1983 | Viellefont et al. | 204/12 |
| 4,840,710 A | | 6/1989 | Middlin et al. | 204/12 |
| 5,074,968 A | | 12/1991 | Maruyama et al. | 205/76 |

* cited by examiner

*Primary Examiner*—Bruce F. Bell
(74) *Attorney, Agent, or Firm*—Smith-Hill and Bedell

(57) ABSTRACT

The invention relates to a device for at least partly removing a deposit created in the electrolytic refining or electrowinning of metal from the surface of the mother plate used as an electrode in the refining or electrowinning process, said device comprising at least one member for removing the deposit and at least one member for controlling the removal member with respect to the deposit to be removed. According to the invention, the device comprises at least one gripping element that is used for creating a mechanical contact between the deposit and the removal member, said gripping element being connected to a control member, to which there are coupled both the shaft part of the gripping element and the deposit removal member.

23 Claims, 2 Drawing Sheets

DEVICE FOR REMOVING DEPOSIT CREATED IN ELECTROLYTIC REFINING OR ELECTROWINNING

The present invention relates to a device for removing a deposit created in the electrolytic refining or electrowinning of metals from the surface of the mother plate used as an electrode in the refining or electrowinning process, when said removal is advantageously carried out without bending and hammering the mother plate.

BACKGROUND OF THE INVENTION

When manufacturing many metals, such as copper, zinc or nickel, one of the major steps in the manufacturing process is electrolysis, where the metal to be produced is precipitated by means of an electric current conducted to the electrolyte on the surface of the electrode, i.e. the cathode. Normally the cathode is an object provided with a hanger for suspending the cathode in the electrolytic tank and connecting it to the circuit, as well as with a plate-like part to be immersed in the electrolyte, i.e. the mother plate, on the surface of which the metal to be produced is precipitated.

In modern production plants, the cathode plate is usually made of a different metal than the metal to be produced, and the two vertical edges of the cathode, or all three edges that are immersed in the electrolyte, are provided with electrical insulation, made for example of plastic, so that the metal precipitated on the surface of the cathode plate is divided in two separate plates at least on its two vertical sides. The production of permanent cathodes of the above described type, made of two different metals, is realised so that the metal to be produced is removed in plate-like sheets from the surfaces of the permanent cathodes, and the permanent cathodes are continuously circulated between the electrolytic tanks and the removal station. The electric insulation provided at the edges of the permanent cathodes is necessary particularly for removing and processing the precipitated metal.

The operation of the production process and the production of metal require that the metal to be produced is sufficiently often removed from the cathode plate surface. The interval between the removals is typically from one to seven days, and because the removal normally requires large-scale material transfers and an interruption in the process, the interval between removals is attempted to be made as long as possible. Therefore the metal deposits nowadays are usually fairly thick, generally well over 5 mm.

Because the plants producing copper, nickel and zinc are large in production quantities, said plants include thousands or tens of thousands of cathode plates, and even the number of cathode plates that daily enter removal is easily thousands or tens of thousands. Consequently, in order to remove the metal to be produced from the surfaces of permanent cathodes there are used mechanised and automated stripping machines. Moreover, because permanent cathodes are expensive in production costs, the maximisation of their working life is extremely important for the plant in question. It is true that the insulation provided at the cathode edges can be renewed, but it is advantageous for the plant to extend its lifetime, too. Thus among the most important features of a stripping machine is that the machine does not damage the permanent cathodes nor the permanent cathode edge insulation, that the produced metal is removed reliably and that the stripping machine is made to operate at a high speed.

SUMMARY OF THE INVENTION

Thus the object of the present invention is to realise an improved device for removing a deposit created in electrolytic refining or electrowinning from the surface of the mother plate used as an electrode, so that hard strains directed to the mother plate itself are avoided, such as bending or striking. The essential novel features of the invention are apparent from the appended claims.

According to the invention, in order to remove a metal deposit created in electrolytic refining or electrowinning, such as a copper, nickel or zinc deposit, from the surface of the mother plate of the electrode used in the electrolytic refining or electrowinning, there is employed a stripping machine that can be applied to removing the deposit essentially completely, or to removing the deposit only for an extent where a separate member can enter between the deposit and the mother plate in order to perform the final removal. The stripping machine according to the invention is provided with at least one gripping element, and by means of at least one control member connected to said gripping element, the gripping element is set to mechanical contact with the deposit to be removed from the mother plate. In order to position the gripping element essentially precisely with respect to the deposit, at least one of the gripping element control members is set to contact with the deposit, or at least with the surface that is clear of the metal deposit of the electrode. In connection with the removal operation proper, the gripping element of the stripping machine according to the invention is moved by means of a removal member proper, connected to the control member.

The stripping machine according to the invention is supported against a frame structure that simultaneously constitutes a removal station for the deposit created on the mother plate in the electrolytic refining or electrowinning process. Normally the deposit in electrolytic refining or electrowinning is created on two opposite sides of the mother plate, and therefore there are at least two removal members arranged in the removal station, advantageously so that for each deposit, there is provided at least one device on both sides of the mother plate. If a separate device is used for removing the deposit after a preliminary removal carried out by a stripping machine according to the invention, said separate device being for instance a knife, said removal knife can also be installed in the same removal station. The removal knife can also be located as separate from the removal station formed by the stripping machine.

When using a stripping machine according to the invention, the mother plate that is circulated between the electrolytic refining or electrowinning process and the removal station, and which in that case is a permanent cathode, does neither have to be bent nor otherwise strained, which is advantageous for the working life of the permanent cathode. Moreover, owing to the control member provided in the stripping machine, the gripping element is not in contact with the surface of the mother plate, i.e. of the permanent cathode. Further, neither the control member nor any other part of the stripping machine is in contact with those parts of the permanent cathode that in electrolytic refining or electrowinning go underneath the electrolyte surface, in which case the part of the permanent cathode that is active in creating the deposit is made to remain essentially unbroken and advantageous for the creation of the deposit. The advantageous nature of the stripping machine according to the invention is enhanced by the fact that the motions directed to the control members and to the gripping element are essentially short, and thus the removal operation proper can be carried out rapidly.

When using the stripping machine according to the invention, the mother plate serving as the permanent cathode does not have to be bent—said mother plate usually being provided with edge strips in order to prevent the deposit from growing over the mother plate edges—and hence the working life of the mother plate edge strips can be also extended, because bending would possibly cause cracks in the edge strips, which would make said edge strips unusable. Furthermore, when using the stripping machine according to the invention, the removal of particularly thick deposits is carried out reliably, because with thick deposits the required bending forces would be the stronger, the thicker the deposits are.

When the permanent cathode, complete with metal deposits, is attached to the removal station in the beginning of the removal operation, the stripping machine according to the invention is shifted to removal position by utilising the elements connected to the control member of the gripping element, i.e. the gripping element shaft part and the stripping machine proper. The gripping element shaft part is installed movably, so that the control member and consequently also the gripping element can be moved essentially in the direction of the mother plate surface. On the other hand, the stripping machine proper is installed movably, so that the stripping machine can be moved in a direction essentially perpendicular to the mother plate surface. Moreover, the gripping element shaft part is installed so that the shaft part can be rotated around its axis. Owing to these separate motions, the gripping element can be set to a position that is advantageous for the removal with respect to the metal deposit.

In the device according to the invention, the moving of the gripping element and simultaneously the moving of the control member either in an essentially parallel direction with the mother plate surface, or in an essentially perpendicular direction to the mother plate, can advantageously be carried out either hydraulically, pneumatically or electrically. Similar methods can also be applied when rotating the gripping element shaft part around its axis.

BRIEF DESCRIPTION OF THE DRAWINGS

The invention is described in more detail below, with reference to the accompanying drawings, where.

DETAILED DESCRIPTION OF THE INVENTION

Figure 1:
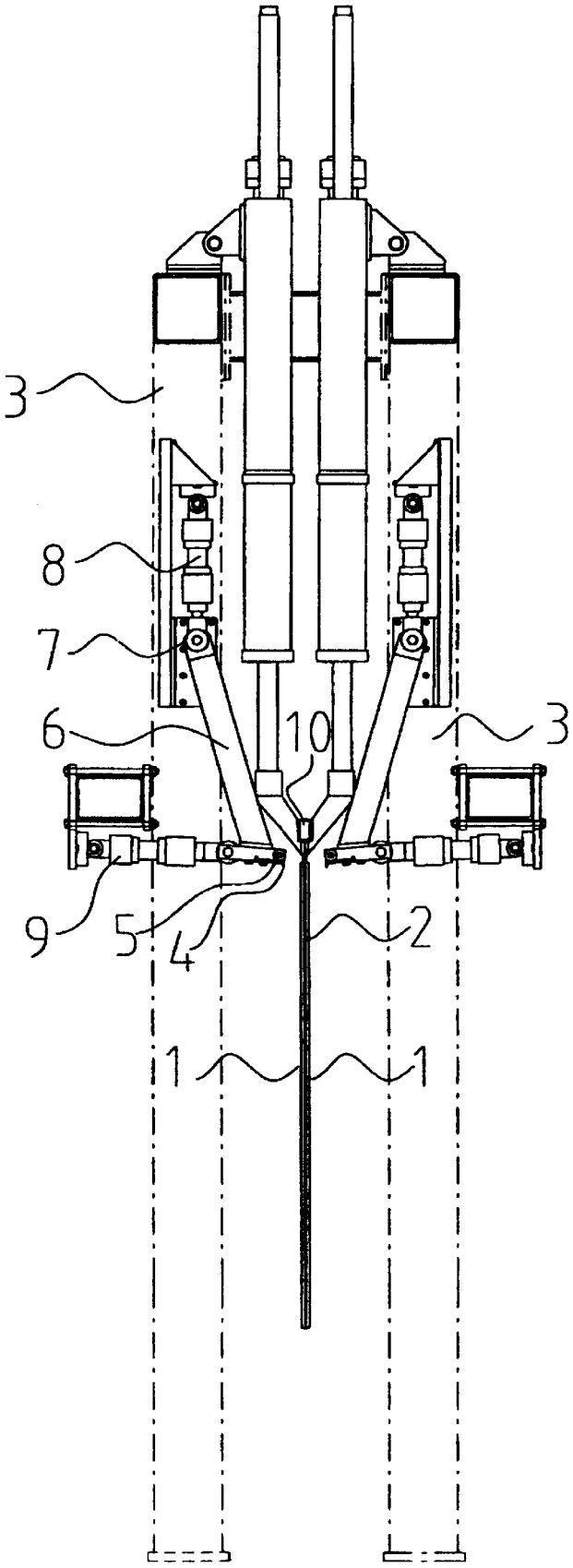
FIG. 1 illustrates a preferred embodiment of the invention, seen from the side in a partial cross-section.

According to the drawings, the permanent cathode 2 that is partly covered by metal deposits 1 and will be processed in the removal station is supported against the removal station frame structure 3. On both sides of the permanent cathode 2, there is installed a stripping machine according to the invention, so that a gripping element 4 provided therein is first connected to a control member 5 and further to a shaft part 6. The shaft part 6 is further connected to an articulation 7 that allows the shaft part 6 to turn around its axis. The articulation 7 is further provided with a drive member 8 that moves the gripping element 4 essentially in a direction parallel to the surface of the permanent cathode 2. The control member 5 also is connected to a removal member 9, whereby the control member 5 and the gripping element 4 are moved essentially in a direction perpendicular to the surface of the permanent cathode 2 in order to remove the metal deposit 1.

When the stripping machine according to the invention is in operation, the removal member 9 connected to the control member 5 first shifts the control member 5 to contact with the deposit-free surface of the permanent cathode 2, said deposit-free surface being located below the hanger 10 of the permanent cathode 2, in proportion to the length that the permanent cathode 2 has during the electrolytic refining or electrowinning process and simultaneously during the deposit creation process been located above the electrolyte solution. The control member 5 is shifted to the deposit-free surface of the permanent cathode so that the shaft part 6 turns around its axis placed in the articulation 7. The control member 5 is advantageously adjusted so that the gripping element 4 itself does not get into contact with the deposit-free surface of the permanent cathode 2, but the distance between the gripping element 4 and the permanent cathode 2 is advantageously at least 0.5–1 mm. Respectively, the drive member 8 connected to the articulation 7 moves both the shaft part 6 and the control member 5 and grip element 4 connected to said shaft part 6 towards the metal deposit 1. Simultaneously as the removal member 9 connected to the control member 5 keeps the control member 5 in.contact with the surface of the permanent cathode 2, the drive member 8 connected to the articulation 7 moves the control member 5 and the gripping element 4 towards the metal deposit 1, so that the gripping element 4 gets into contact with the edge of the metal deposit 1 and essentially penetrates the metal deposit 1. The gripping element 4 can also be made to operate in a manner where the gripping element 4 is guided to in between the permanent cathode 2 and the metal deposit 1. In each alternative embodiment, the control member 5 is set to contact with that surface of the permanent cathode 2 that is free of the metal deposit 1.

Figure 2:
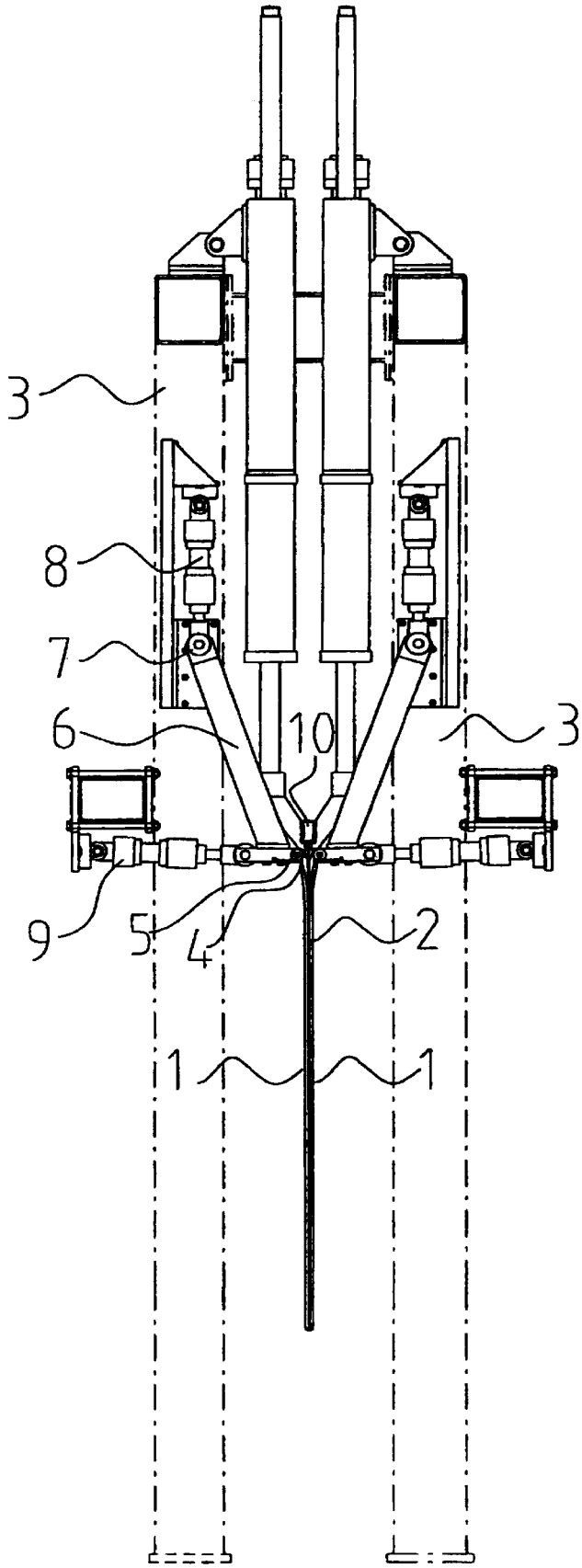
FIG. 2 illustrates the embodiment of FIG. 1 in the beginning of the removal operation.

According to FIG. 2, when the gripping element 4 is in contact with the metal deposit 1 in order to remove the metal deposit 1 from the permanent cathode 2, the removal member 9 connected to the control member 5 moves the control member 5 and the gripping element 4 away from the surface of the permanent cathode 2. Now the metal deposit 1, or at least the edge of the metal deposit 1, follows the gripping element 4 and is removed from the surface of the plate part of the permanent cathode 2. If the metal deposit 1 is essentially rigid, and the allowed moving distance for the removal member 9 connected to the control member 5 is sufficiently long, the metal deposit 1 is completely removed by means of the stripping machine according to the invention. In another case, the gripping element 4 is used for removing the edge of the metal deposit 1, and the final removal of the metal deposit 1 is carried out by a separate mechanism, advantageously for instance a removal knife.

What is claimed is:

1. A device for at least partly removing a deposit created in electrolytic refining or electrowinning from the surface of the mother plate used as an electrode in the refining or electrowinning process, said device comprising at least one member for removing the deposit and at least one member for controlling the removal member with respect to the deposit, characterized in that the device comprises at least one gripping element that is used for creating a mechanical contact between the deposit and the removal member, said gripping element being connected to a control member, to which there are coupled both the shaft part of the gripping element and the deposit removal member.

2. A device according to claim 1, characterized in that the gripping element is installed so that it is movable in a direction essentially parallel to the surface of the mother plate and in a direction essentially perpendicular to the surface of the mother plate.

3. A device according to claim 1, characterized in that in order to move the gripping element in a direction essentially parallel to the surface of the mother plate, the shaft part of the gripping element is provided with a drive member.

4. A device according to claim 1, characterized in that the moving of the gripping element in a direction essentially perpendicular to the surface of the mother plate can be carried out by means of a removal member of the deposit.

5. A device according to claim 1, characterized in that the shaft part of the gripping element is rotated around its axis.

6. A device according to claim 1, characterized in that the moving of the gripping element both in a direction essentially parallel to the surface of the mother plate and in a direction essentially perpendicular to the surface of the mother plate can be carried out hydraulically.

7. A device according to claim 1, characterized in that the moving of the gripping element both in a direction essentially parallel to the surface of the mother plate and in a direction essentially perpendicular to the surface of the mother plate can be carried out pneumatically.

8. A device according to claim 1, characterized in that the moving of the gripping element both in a direction essentially parallel to the surface of the mother plate and in a direction essentially perpendicular to the surface of the mother plate can be carried out electrically.

9. A device according to claim 1, characterized in that in order to remove the deposit, the control member of the gripping element is in contact with that part of the mother plate that is clear of the deposit, simultaneously as the gripping element is in contact with the deposit to be removed.

10. Apparatus for processing a mother plate used as an electrode in an electrolytic refining or electrowinning operation, the mother plate having a deposit on a surface thereof, said apparatus comprising:

a means for securing the mother plate in a predetermined position, a control member, at least one gripping element that is attached to the control member and includes an engagement formation for physically engaging the deposit, a first displacement means coupled to the control member for displacing the control member towards and away from a location in which the engagement formation is positioned for physically engaging the deposit, and a second displacement means coupled to the control member for forcing the engagement formation into physical engagement with the deposit when the control member is in said location for thereby creating a mechanical connection between the deposit and the control member, and wherein the first displacement means is operative when the engagement formation has been forced into physical engagement with the deposit for displacing the control member away from said location and thereby at least partially removing the deposit from the mother plate.

11. Apparatus according to claim 10, wherein the first displacement means is operative for displacing the control member substantially perpendicular to the surface of the mother plate and the second displacement means is operative for displacing the control member substantially parallel to said surface.

12. Apparatus according to claim 10, wherein the second displacement means comprises a shaft connected to the control member and a drive member connected to the shaft.

13. Apparatus according to claim 12, wherein the shaft is pivotally connected to the drive member.

14. Apparatus according to claim 10, wherein the first displacement means is operated hydraulically, pneumatically or electrically.

15. Apparatus according to claim 10, wherein the second displacement means is operated hydraulically, pneumatically or electrically.

16. Apparatus according to claim 10, wherein a portion of said surface of the mother plate is free of deposit and the control member engages said portion of said surface when the control member is in said location.

17. A method of processing a mother plate used as an electrode in an electrolytic refining or electrowinning operation, the mother plate having a deposit on a surface thereof, said method comprising:

securing the mother plate in a predetermined position, displacing a gripping element towards the mother plate so that an engagement formation of the gripping element is positioned for physically engaging the deposit, displacing the gripping element in a manner such as to force the engagement formation into physical engagement with the deposit, and displacing the gripping element away from the mother plate so that the deposit is at least partially removed from the mother plate.

18. A method according to claim 17, wherein displacing the gripping element towards the mother plate comprises displacing the gripping element substantially perpendicular to said surface of the mother plate and displacing the gripping element in a manner such as to force the engagement formation into physical engagement with the deposit comprises displacing the gripping element substantially parallel to said surface.

19. A method according to claim 17, wherein the gripping element is attached to a control member, a portion of said surface of the mother plate is free of deposit, and the control member engages said portion of said surface when the engagement formation is positioned for physically engaging the deposit.

20. A method according to claim 19, wherein the gripping element is spaced from the mother plate when the control member engages said portion of said surface.

21. A method according to claim 20, wherein the gripping element is at least 0.5 mm from the mother plate when the control member engages said portion of said surface.

22. A method according to claim 17, wherein a portion of said surface of the mother plate is free of deposit, the deposit has an edge that extends along said portion of said surface, the control member engages said portion of said surface when the engagement formation is positioned for physically engaging the deposit, and displacing the gripping element in a manner such as to force the engagement formation into physical engagement with the deposit comprises displacing the engagement portion perpendicular to said edge of the deposit.

23. A method according to claim 17, wherein the deposit has an edge that extends perpendicular to said surface and displacing the gripping element in a manner such as to force the engagement formation into physical engagement with the deposit comprises displacing the engagement portion perpendicular to said edge of the deposit such as to penetrate the deposit at said edge.

* * * * *